US006397923B1

(12) United States Patent
Peting et al.

(10) Patent No.: US 6,397,923 B1
(45) Date of Patent: Jun. 4, 2002

(54) PIPE CORE CLEAN OUT SYSTEM

(75) Inventors: Robert G. Peting; Joseph J. Gobeille, both of Oak Forest, IL (US)

(73) Assignee: Amsted Industries Incorporated, Chicago, IL (US)

( * ) Notice: Subject to any disclaimer, the term of this patent is extended or adjusted under 35 U.S.C. 154(b) by 0 days.

(21) Appl. No.: 09/363,681

(22) Filed: Jul. 29, 1999

(51) Int. Cl.[7] ..... B22D 29/00; A47L 5/38

(52) U.S. Cl. ..... 164/132; 164/158; 164/345; 15/304

(58) Field of Search ..... 164/132, 158, 164/345, 404; 15/304, 308

(56) References Cited

U.S. PATENT DOCUMENTS

| | | | | |
|---|---|---|---|---|
| 1,311,866 A | | 8/1919 | Armstrong | 15/304 X |
| 1,475,989 A | | 12/1923 | Easterday | 15/304 X |
| 1,869,730 A | | 8/1932 | Antle | 15/304 X |
| 2,193,999 A | | 3/1940 | Allen | 15/304 X |
| 2,637,872 A | | 5/1953 | Holbrook | 15/304 X |
| 2,789,296 A | | 4/1957 | Cheadle | 15/304 X |
| 3,280,415 A | | 10/1966 | Moore et al. | 15/4 |

FOREIGN PATENT DOCUMENTS

| | | | | |
|---|---|---|---|---|
| AU | 160706 | | 1/1955 | 15/395 |
| GB | 343652 | * | 2/1931 | 164/345 |
| GB | 547573 | | 9/1942 | 164/158 |
| GB | 1062393 | * | 3/1967 | 15/304 |
| GB | 2222794 A | | 3/1990 | 164/158 |
| JP | 6-91348 | | 4/1994 | 164/158 |
| RU | 350576 | * | 10/1972 | 164/158 |

OTHER PUBLICATIONS

Amsted industries, Inc., Description of Grinder, Oct. 20, 1999 p. 1.

* cited by examiner

*Primary Examiner*—Kuang Y. Lin
(74) *Attorney, Agent, or Firm*—Edward J. Brosius

(57) ABSTRACT

A system for removing waste material from the bell end of a cast iron pipe is disclosed. The system has both a cleaning assembly and an exhaust system. The cleaning assembly has a plurality of wire brushes mounted on a shaft. The shaft is mounted on a cart that also supports a movable part of the exhaust system. The cart moves the wire brushes and part of the movable part of the exhaust system into and out of the bell end of the pipe. A motor on the cart rotates the shaft and brushes, and a tilt mechanism tilts the brushes down to contact the pipe. The pipe is rotated about its central longitudinal axis as the brushes contact and clean the pipe. The rotating brushes clean the sand core from the end of the pipe, and the waste sand is drawn by the exhaust system to the bag house where it is filtered. The exhaust system also includes a stationary duct. The stationary duct has a door and a chute. Larger chunks of waste sand can be removed from the exhaust system through the door and chute.

27 Claims, 5 Drawing Sheets

PIPE CORE CLEAN OUT SYSTEM

BACKGROUND OF THE INVENTION

1. Field of the Invention

The present invention relates to the production of metal pipe, and more particularly, to the production of cast ductile iron pipe with bell ends formed using sand cores, and to a system for removing the sand cores from the cast pipe before the pipe is heat treated.

2. Description of the Prior Art

In the production of objects such as elongate cast metal pipes, centrifugal casting has been commonly used. In such a casting operation, the pipe is cast in a cylindrical mold. Molten metal, such as iron, is fed into the mold through a trough. The trough has a spout at one end which is curved toward the sidewall of the mold. A sand core is inserted into the bell end of the mold to form the inside contour of the pipe bell. The bell end of the pipe's inside contour typically includes one or more annular grooves or depressions defining a gasket seat area to receive a gasket. The mold is rotated and once it is brought up to the appropriate speed, molten metal is poured into the trough. Once the bell end of the pipe has formed, the mold is moved horizontally while rotating. The stream of molten metal discharged from the spout flows tangentially onto the surface of the mold, where it is held in place by centrifugal force. The molten metal forms a homogeneous pipe with a cylindrical bore.

After the pipe has been completely cast, the mold is kept rotating until the pipe has cooled to a desired temperature. The pipe must then be taken from the casting machine and transferred to a heat treating furnace. In some instances, the sand cores are not removed from the cast pipe before annealing; instead, the sand core is allowed to disintegrate at the temperatures in the annealing oven. However, in other types of production, it is desirable to remove the sand core from the bell end of the pipe before the pipe enters the heat treating furnace. This removal of the sand core is particularly important in plants in which the pipe is set vertically and supported on its bell end in the heat treating furnace; remnant pieces of the sand core could cause the pipe to be off-balance in the furnace, and risks toppling of the pipe.

Traditionally, the sand cores have been manually removed. In the manual process, a worker hits the sand core with a hammer to break the core into smaller pieces, and then scrapes out the pieces of the core using a hoe-type of tool. However, this process has required the worker to be in close proximity to the hot pipe, and has been time consuming, adding to the expense of producing cast iron pipe.

SUMMARY OF THE INVENTION

The present invention addresses the problem of removing sand cores from the bell ends of cast metal pipes in an efficient manner.

In another aspect, the present invention provides a system for removing a sand core from a cast iron pipe in a plant for making ductile iron pipe. The ductile iron pipe has a bell end, a hollow interior and an interior surface. The plant has a casting station for casting the iron pipe with a sand core to define the shape of at least a part of the interior surface of the pipe at the bell end of the pipe. The plant also has a heat-treating station downstream from the casting station to heat treat the pipe. The system for removing the sand core is positioned so that the sand core is removed before the cast pipe reaches the heat-treating station. The sand core removal system includes a brush assembly and an exhaust system. The brush assembly includes a shaft with a central longitudinal axis and a brush mounted on the shaft. The brush assembly is rotatable about the central longitudinal axis of the shaft to clean core sand from the pipe. The exhaust system is positioned to draw core sand away from the pipe after the core sand has been cleaned from the pipe. The exhaust system includes a hood. At least part of the brush is positioned within the hood.

DETAILED DESCRIPTION

Figure 1:
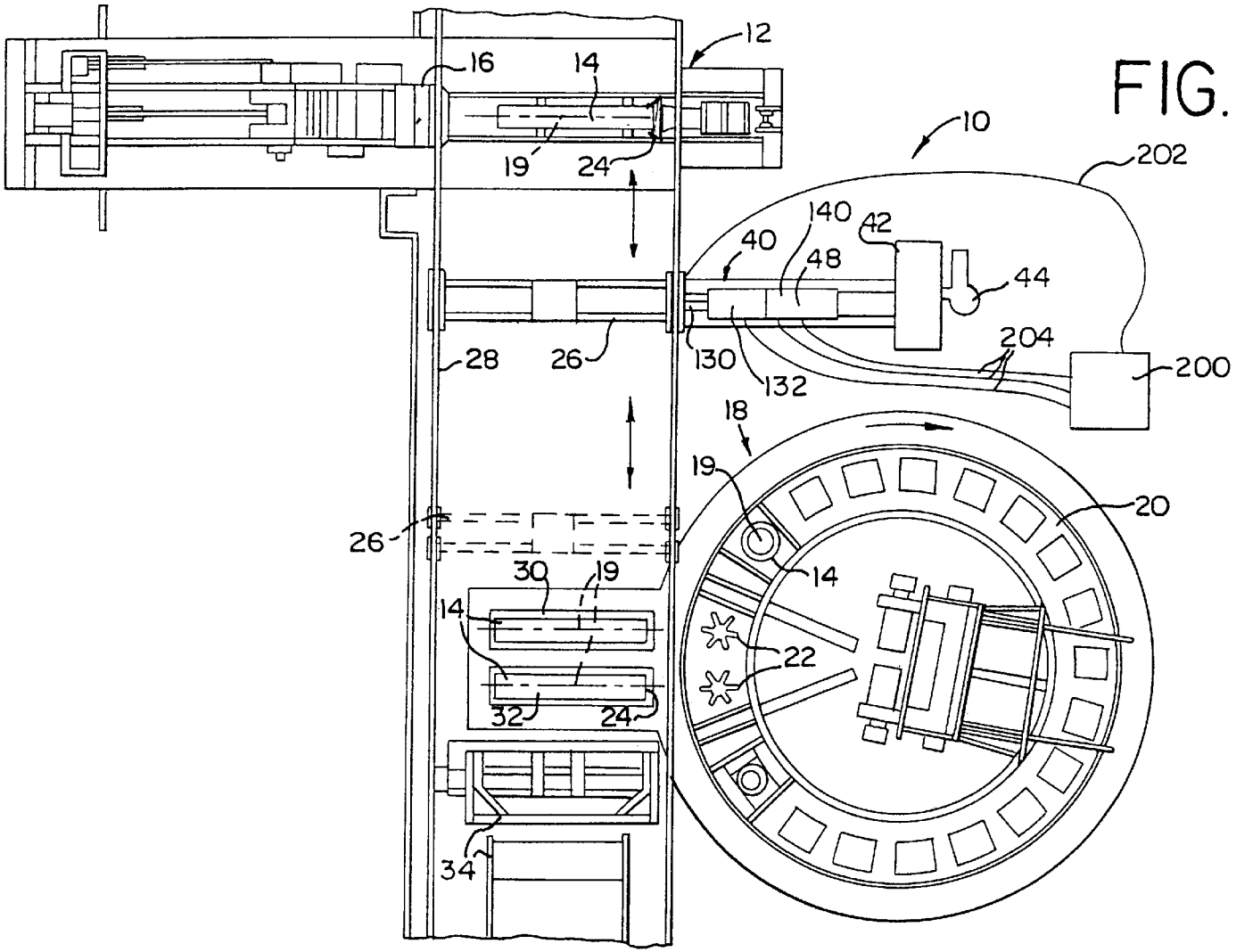
FIG. 1 is a top plan view of an example of a pipe manufacturing facility illustrating the pipe casting station, heat treating station, and location of the system for removing core sand of the present invention, with the parts simplified for clarity.

An example of a manufacturing facility or plant 10 for manufacturing an elongate product such as cast ductile iron pipe is shown in FIG. 1. The illustrated plant 10 includes a casting station 12 for casting iron pipe 14. The casting station 12 may include any centrifugal casting machine 16 known in the art. The illustrated plant 10 also includes a annealing or heat-treating station 18 downstream from the casting station 12, where the cast iron pipe is heated and cooled to produce the desired properties in the metal. In the illustrated embodiment, the heat-treating station 18 includes a carousel 20 with support stations 22 for supporting pipe and moving the pipe into, through and out of a heat-treating furnace. In the illustrated heat-treating furnace, the pipe 14 are vertical when passed through the furnace of the heat-treating station, supported on their bell ends 24 on the support stations 22.

The pipe 14 at the casting station 12 that has exited the casting machine 16 is disposed with its central longitudinal axis 19 in a substantially horizontal position. To move the pipe from the casting station 12 to the heat treating station 18, an overhead crane 26 is-provided. The overhead crane lifts the pipe from the casting station 12 and moves along a runway 28 to move the pipe 14 toward the next production station. Typically, the overhead crane transports the pipe in a substantially horizontal position, and includes bails with powered rollers for rotating the hot pipe during transport. Commercially available cranes may be used. A suitable crane is a P&H crane available from P&H/Morris Material Handling, Inc. of Milwaukee, Wis. Preferably, the crane bail rotates the pipe at a rate of about 3–6 rpm. It should be understood that this crane and rate of rotation are identified as examples only, and the invention is not limited to a particular crane or rate of rotation. The plant may include pipe moving apparatuses 30, 32 as disclosed in U.S. patent application Ser. No. 09/203,902, filed on Dec. 12, 1998 and entitled "Pipe Moving Method, Apparatus and System" for up-ending and down-ending the pipes to place them on and remove them from the carousel supports 22. A twit conveying system 34 may be adjacent to the pipe downender 32 for conveying the annealed pipe to another station in the plant.

Figure 2:
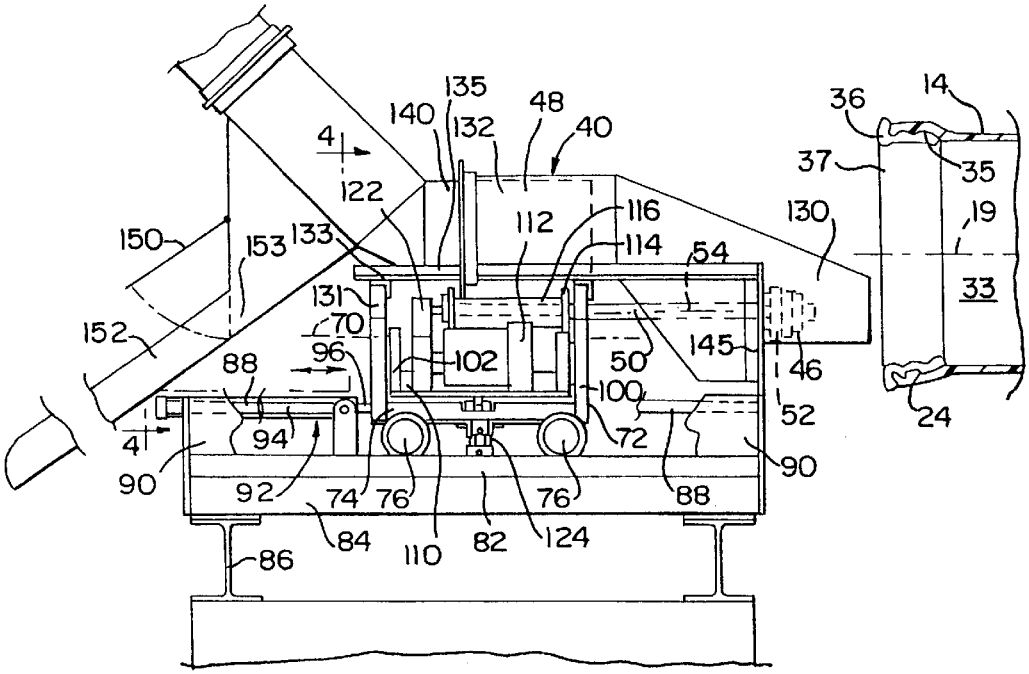
FIG. 2 is a side elevation of an embodiment of the system for removing waste core sand material of the present invention, shown with a brush assembly in a retracted and raised position with respect to the bell end of a cast metal pipe, shown in cross-section and with a sand core at the bell end of the pipe.
Figure 3:
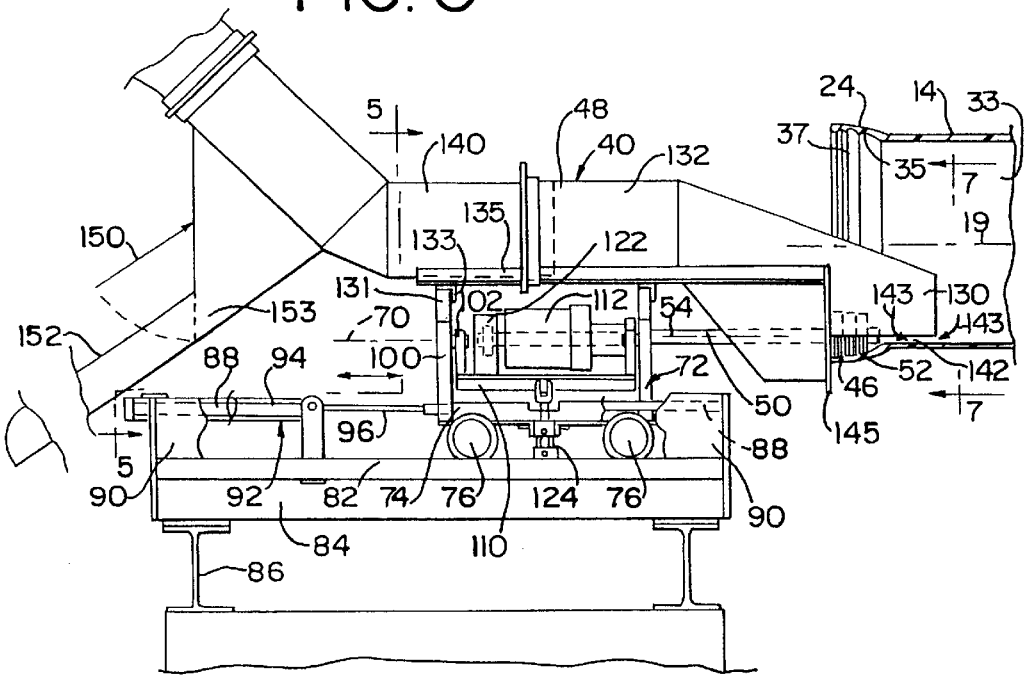
FIG. 3 is a side elevation of the system of FIG. 2, shown with the brush assembly in an extended and lowered position with respect to the bell end of a cast metal pipe, shown in cross-section and with the sand core removed.
Figure 5:
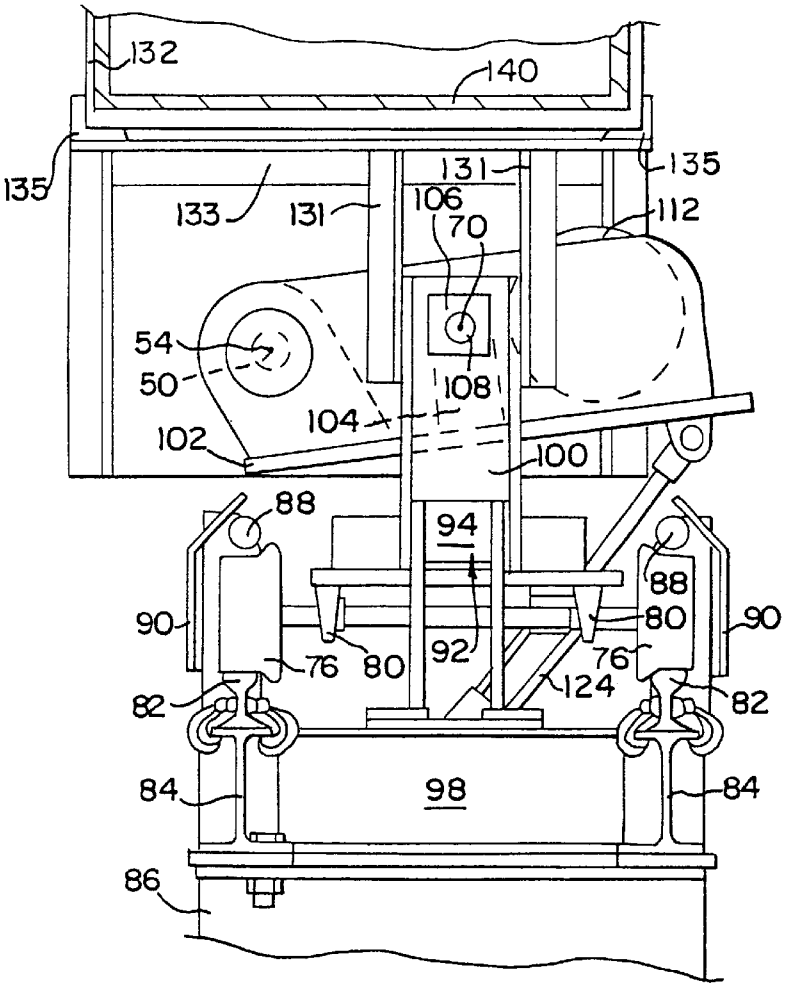
FIG. 5 is an end view of the linearly-movable cart, tilting frame and drive mechanism for the cart with the exhaust system shown in section, taken along line 5—5 of FIG. 3, and showing the tilt frame in the position shown in FIG. 3 to position the brush assembly in the lowered position.
Figure 4:
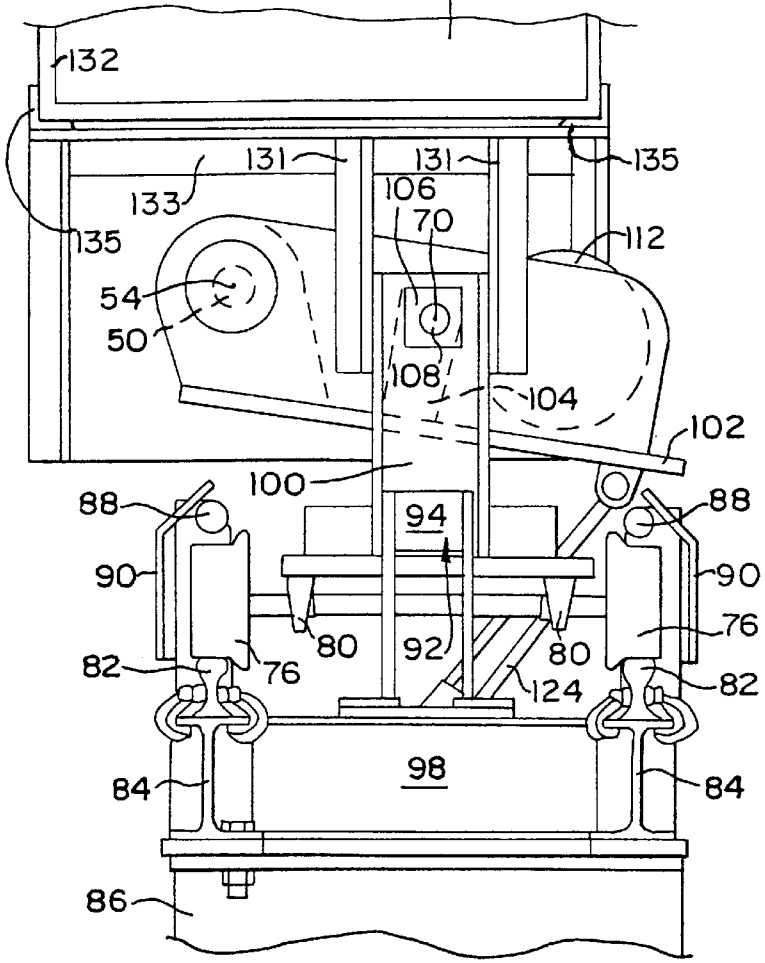
FIG. 4 is an end view of the linearly-movable cart, tilting frame and drive mechanism for the cart with the exhaust system shown in section, taken along line 4—4 of FIG. 3, and showing the tilt frame in the position shown in FIG. 2 to position the brush assembly in the raised position.

As shown in FIGS. 2–3, the pipe 14 has a hollow interior 33, and an interior surface 35. The pipe 14 has an opening 37 at the bell end 24. The interior surface 35 of the bell end 24 of the pipe 14 is defined at the casting station 12 by an annular sand core shown at 36 in FIGS. 2, 8, 10 and 12. After casting, the sand core is no longer needed and comprises waste material. In the illustrated type of plant, the sand core 36 is removed before the pipe reaches the heat-treating station 18. Since in the heat-treating furnace the pipe is supported vertically, core sand at the bell end could cause the pipe to be askew on the supports 22.

The present invention provides a system for removing the waste sand core material from the cast iron pipe. The waste sand core removal system is shown at 40 in FIGS. 1–3. The waste sand core removal system is connected to the plant bag house 42 in the illustrated embodiment, and the bag house is connected to an air-moving device 44 to draw air and sand through the sand core removal system to the bag house 42. The air-moving device 44 may comprise any standard fan, and preferably is one that moves or draws at least about 12,000 cubic feet per minute of air through the sand core removal system 40. The bag house is of standard design for filtering air in such manufacturing facilities. The sand core removal system 40 is positioned upstream of the heat-treating station 18 so that the sand core is removed from the pipe 14 before the pipe 14 reaches the heat-treating station 18.

It should be understood that the core sand removal system of the present invention can be used in plant layouts other than that illustrated in FIG. 1, and that the invention is not limited to that plant layout. Moreover, the system of the present invention is not limited to plants having heat-treating furnaces with vertically-disposed pipes.

The illustrated system 40 for removing sand cores from metal pipes includes a cleaning assembly 46 and an exhaust system 48. The cleaning assembly 46 serves to clean the core sand from the pipe. The cleaning assembly 46 is rotatable. As it rotates against the sand core, the cleaning assembly cleans waste core sand material from the pipe by rubbing, wiping, scouring, breaking off or otherwise loosening the sand off of the interior surface of the pipe. The exhaust system is positioned to move or draw the waste core sand material away from the pipe after the waste core sand material has been cleaned from the pipe.

In the illustrated embodiment, the cleaning assembly 46 comprises a brush assembly. The illustrated brush assembly includes a shaft 50 and a plurality of annular brushes 52 mounted concentrically on the shaft 50. The shaft 50 and annular brushes 52 are rotatable about the central longitudinal axis 54 of the shaft 50.

Figure 8:
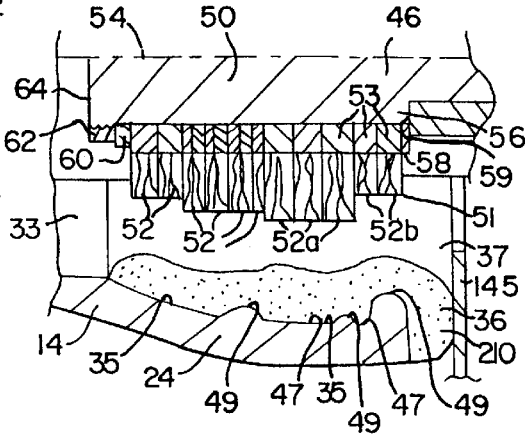
FIG. 8 is an enlarged quarter section view of the bell end of a cast metal pipe with the sand core in place on the pipe, with the brush assembly and hood of the waste core sand removal system in the interior of the pipe, and with the brush assembly in the raised position.
Figure 9:
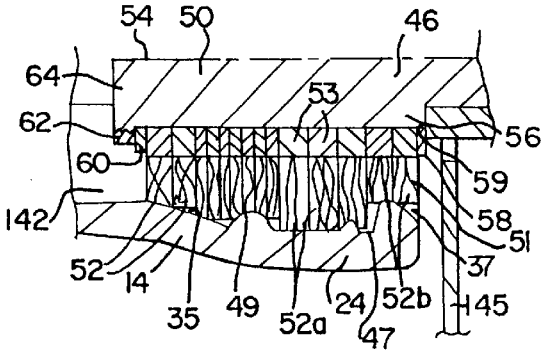
FIG. 9 is an enlarged quarter section view of the bell end of the cast metal pipe of FIG. 8, shown with the brush assembly in the lowered position and the sand core removed.
Figure 12:
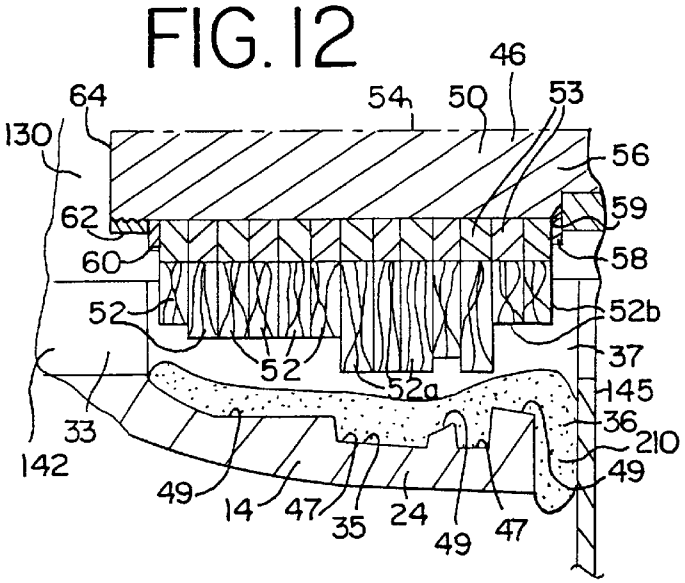
FIG. 12 is an enlarged quarter section view of the bell end of another size cast metal pipe, with the sand core in place on the pipe, with the brush assembly and hood of the waste core sand removal system in the interior of the pipe, and with the brush assembly in the raised position.
Figure 13:
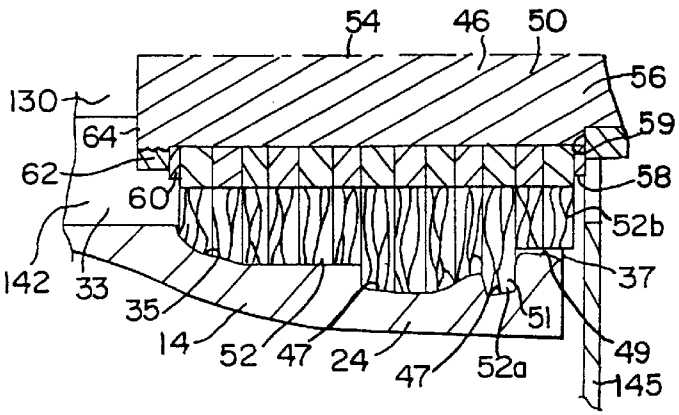
FIG. 13 is an enlarged quarter section view of the bell end of the cast metal pipe of FIG. 12, shown with the brush assembly in the lowered position and the sand core removed.
Figure 10:
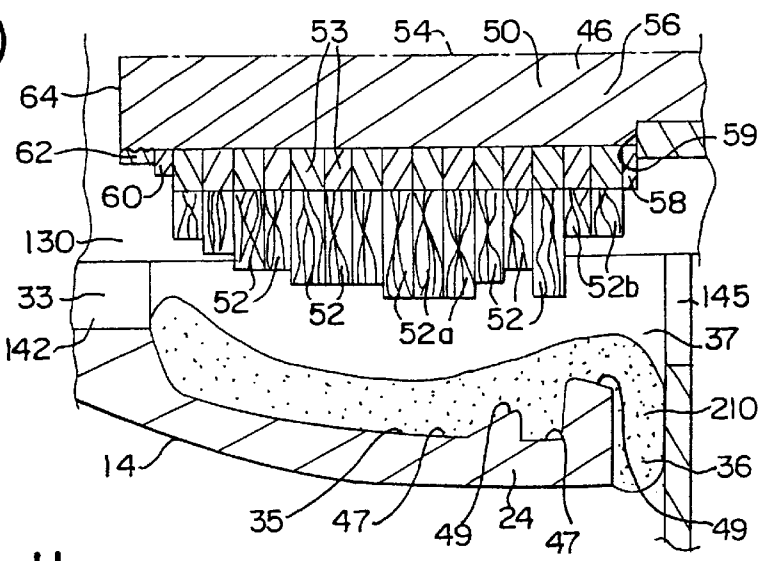
FIG. 10 is an enlarged quarter section view of the bell end of another size cast metal pipe, with the sand core in place on the pipe, with the brush assembly and hood of the waste core sand removal system in the interior of the pipe, and with the brush assembly in the raised position.
Figure 11:
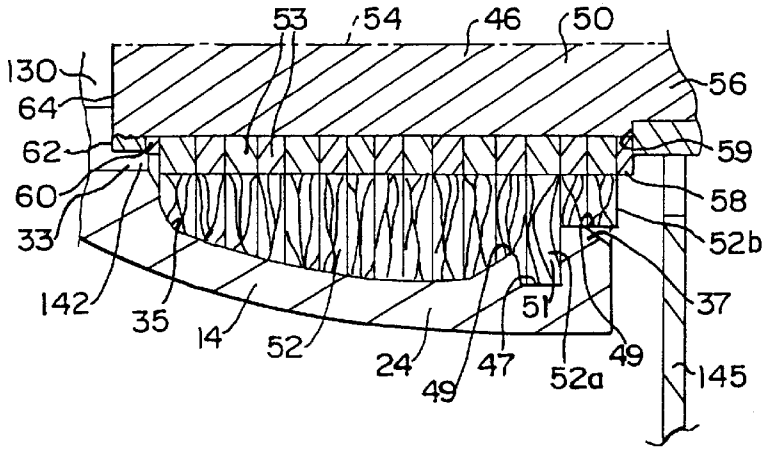
FIG. 11 is an enlarged quarter section view of the bell end of the cast metal pipe of FIG. 10, shown with the brush assembly in the lowered position and the sand core removed.

Although the brush assembly 46 could comprise a single brush on a shaft, use of a plurality of individual annular brushes 52 is advantageous. Brushes of various diameters may be selected and grouped so that the outer contour of the brush assembly corresponds generally to the contour of the interior surface 35 of the bell end 24 of the pipe 14. Thus, as shown in FIGS. 8–13, larger diameter brushes may be provided to correspond with grooves, recesses or indentations 47 in the interior surface 35 of the bell end 24 of the pipe 14. Smaller diameter brushes may be provided to correspond with raised areas 49 of the interior surface 35 of the bell end 24 of the pipe 14 and areas of decreased pipe inner diameter. In FIGS. 8,10, and 12, some of the larger diameter brushes are shown at 52*a* and some of the smaller diameter brushes are shown at 52*b*. As shown in FIGS. 9, 11 and 13, use of the illustrated combinations of brushes allows for part of the brush assembly to reach into the grooves or indentations 47 when the brush assembly 46 is in the lowered position.

Various combinations of brushes are shown in FIGS. 8–13. In the embodiment of FIGS. 8–9, combinations of 6-inch diameter, 6-½-inch diameter, and 7-inch diameter brushes are used, totaling 15 individual brushes. Other combinations and numbers of brushes may be used, as shown in the embodiment of FIGS. 10–11 and the embodiment of FIGS. 12–13. Other diameter brushes may also be used, such as 8-inch Manufacturing unit of Jason Incorporated of Cleveland, Ohio, as knot wire wheel brushes, using either stainless steel wire or steel wire for the brush element 51 mounted on annular arbors 53. The arbors 53 are mounted concentric on the shaft 50, and may be keyed to the shaft if desired. It should be understood that these brushes and brush diameters are provided by way of example only; other brushes may be used in other configurations, and it is expected that other materials may be used as well. It is expected that one of ordinary skill in the art would consult a brush supplier to obtain a suitable brush for the environment, and would select a material that will withstand the temperatures of the pipe at this stage of the manufacturing process, and select a material that will be economical while providing a satisfactory working life.

It should also be understood that devices other than brushes may be used in the cleaning assembly. For example, it may be desirable to use grinding wheels, or combinations of wheels and brushes for the cleaning assembly. Alternatively, a bladed object could be used to remove the core without contacting the iron pipe; a blade or knives could be used for scoring the core. Instead of a rotating cleaning assembly, a needle gun or chipping hammer could be used. The selected cleaning mechanism can be moved into and out of the interior of the pipe to clean the waste core material from the pipe.

The shaft 50 of the cleaning or brush assembly 46 may comprise a single piece or a multiple-piece element. For example, the shaft may include a mandrel at the end to which the brushes are mounted. The shaft 50 or mandrel may have a reduced diameter portion 56 adjoining an annular shoulder 59 at the juncture with the remainder of the larger diameter part of the shaft, as shown at 56 in FIGS. 8–13. A washer 58 may bear against the shoulder 59, with the first brush 52 placed against the washer 58. Another washer 60 may be placed against the last brush 52, and then the entire group of brushes may be locked in place with a nut 62 threaded onto the free end 84 of the shaft 50 or mandrel. If production shifts to another type of pipe, the nut 62 can be removed so that the brushes 52 may be moved or replaced to change the contour of the brush assembly. Worn brushes can also be readily replaced in this manner. The nut 62 can then be replaced and tightened to lock the new group of brushes in place on the shaft or mandrel.

In the illustrated sand core removal system 40, the cleaning or brush assembly 46 is moved in three ways: the cleaning or brush assembly 46 is moved linearly into and but of the hollow interior 33 of the pipe in a direction parallel to the central longitudinal axis 19 of the pipe 14; the cleaning or brush assembly 46 is pivotable about a tilt axis 70 to move the assembly between the raised position shown in FIG. 2 to the lowered position shown in FIG. 3; and the cleaning or brush assembly 46 is rotatable about the central longitudinal axis 54 of the shaft 50.

To move the cleaning or brush assembly 46 linearly toward and away from the pipe 14, the illustrated cleaning or brush assembly 46 is mounted on a linearly-movable cart 72. In the illustrated embodiment, the linearly movable cart 72 includes a frame 74 mounted on two sets of wheels 76 and axles 78. The frame 74 is mounted on the axles through pillow blocks 80 or other suitable bearings. The wheels 76 are set to roll along a set of parallel rails 82. The rails 82 are supported on I-beams 84. The I-beams 84 are supported on a support frame 86 that rests on the plant floor. The illustrated support frame 86 positions the cart 72 and brush assembly 46 above the plant floor, aligned generally with the level of pipes carried by the overhead crane 26. To prevent the rolling cart 72 from tipping over, a pair of elongate rods 88 are provided, overlying and generally parallel to the rails 82 above the wheels 76, serving to trap the wheels 76 between the rods 88 and the rails 82. The ends of the rods 88 may be connected to suitable supports. An outer guard 90 may extend along the length of both of the rails 82 and rods 88. For clarity of illustration, the guard 90 is not shown in FIG. 6.

The illustrated embodiment of the sand core removal system includes a drive mechanism 92. The drive mechanism 92 serves to move the linearly movable cart 72, tilting frame 102 and cleaning or brush assembly 46 toward and away from the pipe 14. The illustrated drive mechanism 92 moves the cart 72 along the rails 82, and comprises a pneumatic drive, with a cylinder 94 and a piston 96. The cylinder 94 is secured to the support frame through a cross-beam 98. The piston 96 is secured to the frame 74 of the rolling cart 72. A suitable drive mechanism 92 is a commercially available pneumatic cylinder from Parker Hannifin Corp. of Cleveland, Ohio, model 3.25 DB-2AU14A 16.000, having a stroke length of 16 inches, a cylinder diameter of 3.25 inches, and operating at a pressure of 100 psi. It should be understood that this drive mechanism is identified for purposes of illustration only, and that the present invention is not limited to this particular drive and is not limited to hydraulic drives. Other types of drives may be used such as hydraulic cylinders, chain and sprocket, rack and pinion, and standard linear drive mechanisms, for example. However, a pneumatic drive is preferred; since the cart is moved up to where an element carried by the cart contacts the pipe, the give provided by a pneumatic drive is advantageous.

Figure 6:
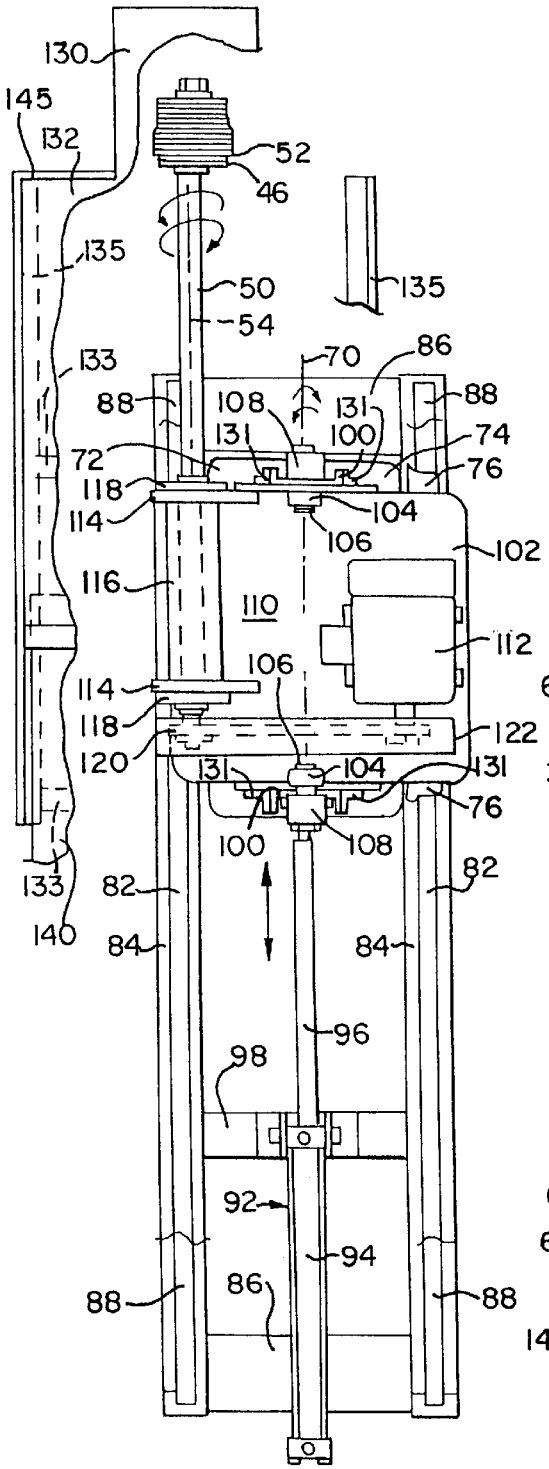
FIG. 6 is a top plan view of the linearly-movable cart, tilting frame and brush assembly of the waste core sand removal system of FIGS. 2–3, with parts of the exhaust system and parts of the support structure for the movable hood and duct removed for clarity.
Figure 7:
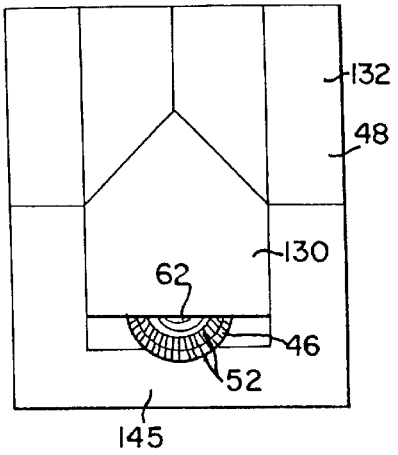
FIG. 7 is an end view taken along line 7—7 of FIG. 3, with parts removed for clarity, showing the hood of the exhaust system and part of the brush assembly of the waste core sand removal system.

The frame 74 of the rolling cart 72 has a pair of spaced upright channels 100 that carry and support a tiltable frame 102. The tiltable frame 102 has a pair of spaced upright bars 104 carrying pins 106 that are received in bearings 108 supported on the upright channels 100. The pins 106 have co-linear central longitudinal axes along the tilt axis 70 of the tiltable frame 102. Thus, the tiltable frame 102 is suspended on the upright channels 100 of the rolling cart 72, and may pivot or tilt about the tilt axis 70 defined by the central longitudinal axes of the pins 106. As shown in FIG. 6, the tilt axis 70 is spaced from and parallel to the central longitudinal axis 54 of the shaft 50 of the brush assembly 46.

The tiltable frame 102 also includes a base plate 110 connected to the two upright bars 104 through welding or other suitable connection means. An electric motor 112 is mounted off-center on the base plate 110, along with two off-center support plates 114. The off-center support plates 114 may be connected to the base plate through welding, for example, or other suitable connection means. The off-center support plates 114 are spaced and include aligned apertures. A spacer tube 116 extends between and is connected to the off-center support plates 114. The shaft 50 of the brush assembly 46 extends through the aligned apertures of the off-center support plates 114, through the spacer tube 116 and through suitable bearings 118 at each off-center support plate 114. Thus, the cleaning or brush assembly 46 is supported on the tiltable frame 102 with the shaft central longitudinal axis 54 parallel to the tilt axis 70 of the tiltable frame 102. As shown in FIG. 6, the annular brushes 52 and shaft 50 extend out beyond the tiltable frame 102 and linearly-movable cart 72.

One end of the shaft 50 is connected to a mechanism such as a drive wheel that is connected through a drive belt or chain 120 to be driven by the motor 112. Preferably, the motor 112 selectively rotates the shaft 50, and rotation of the shaft 50 and the entire brush assembly 46 is preferably at a rate of about 1700–1800 rpm. The drive belt or chain 120 may be covered by a guard 122. A standard squirrel cage 3-phase motor may be used.

In the illustrated embodiment, a powered tilting device 124 is connected to the linearly movable cart 72 and to the base plate 110 of the tiltable frame 102 to tilt the tiltable frame 102 about its tilt axis 70 to thereby move the cleaning or brush assembly 46 toward and away from the interior surface 35 of the pipe 14 at the bell end 24. The powered tilting device 124 may comprise a pneumatic drive, with a cylinder pivotally connected to the frame 74 and the piston pivotally connected to the other frame 102. A suitable powered tilting device is a commercially available pneumatic cylinder from Parker Hannifin Corp. of Cleveland, Ohio, model 3.25DB-2AU14A 6.000, having a stroke length of 6 inches, a cylinder diameter of 3.25 inches, and operating at a pressure of 100 psi. It should be understood that this powered tilting device is identified by way of example only, and that the present invention is not limited to this particular tilting device or to pneumatic devices. Other commercially available mechanisms may be used, such as hydraulic cylinders, for example. However, a pneumatic device is preferred to bounce the brushes up and down on the core, and to yield or give under excessive pressure.

As shown in FIGS. 2–3, in the illustrated embodiment, the tilt axis 70 is generally parallel to the central longitudinal axis 19 of the pipe; pivoting the cleaning or brush assembly about the tilt axis 70 moves the axis of rotation 54 toward and away from the interior surface 35 of the pipe. In the illustrated embodiment, the axis of rotation 54 of the cleaning or brush assembly 46 is parallel to the central longitudinal axis 19 of the pipe 14, although it should be understood that this alignment is not necessary.

As shown in FIGS. 2–3, the linearly-movable cart 72 also supports part of the exhaust system 48 of the sand core removal system 40. The exhaust system 48 in the illustrated embodiment includes a hood 130 and a movable duct 132 supported to move with the cart 72 and cleaning or brush assembly 46. The hood 130 overlies at least part of the cleaning or brush assembly 46; in the illustrated embodiment, the hood 130 overlies the annular brushes 52 of the brush assembly 46 and is movable into and out of the hollow interior 33 of the pipe 14 through the opening 37 at the bell end 24 of the pipe 14. The hood 130 is connected to the movable duct 132 so that the movable duct may receive exhaust from the hood.

As shown in FIGS. 2–5, the linearly-movable cart 72 in the illustrated embodiment has a pair of upright metal angles 131 attached to each upright channel 100. Each pair of upright metal angles 131 is connected to a horizontal angle 133 that is connected to two horizontal angles 135 that support the movable exhaust duct 132. These connections can be through welding, nuts and bolts, screws, or other standard connections. The hood 130 is connected to and supported by the movable duct 132.

As shown in FIGS. 2–3, the exhaust system 48 also includes a stationary duct 140 connected to receive exhaust from the movable duct 132 when the hood 130 is within the interior 33 of the pipe 14. The stationary duct 140 remains stationary as the linearly movable cart 72, movable duct 132 and hood 130 move toward and away from the pipe 14. In the illustrated embodiment, the stationary duct 140 is telescopically received in the movable duct 132 as the rolling cart 72, movable duct 132 and hood 130 are moved by the pneumatic cylinder 94. In the illustrated embodiment, the stationary duct 140 leads into the bag house 42. The baghouse fan 44 serves as an air-moving device for moving air and waste material or sand from the core 36 into the hood 130 and through the movable duct 132 to the stationary duct 140, and from the stationary duct to the bag house 42.

As shown in FIGS. 2–3, the bottom of the hood 130 is spaced slightly above the interior surface 35 of the pipe 14, leaving a small gap 142. The gap 142 allows for air to enter the hood 130, pulling loose sand from the core 36 with it, as indicated by the arrows labeled 143 in FIG. 3.

As shown in FIGS. 2–3. the stationary duct 140 of the illustrated embodiment also includes a door 150 and a chute 152 for waste material. The chute 152 and door 150 are positioned at the location where the stationary duct 140 extends upward at a steep angle. Any large chunks of sand from the core that are too heavy for the fan 44 to pull up this steep incline into the bag house may accumulate at the chute 152 upstream of the door 150 in the area shown at 153. The pressure drop in the stationary duct 140 due to operation of the fan 44 will generally keep the door 150 closed. However, when the pressure in the stationary duct 132 is beyond a set level, the door 150 may open a passage to the chute 152 for the waste material or debris. The chunks of waste material or debris will then travel down the chute 152 for collection and disposal. The level of pressure in the stationary duct may be varied by slowing or stopping the fan 44 so that the door 150 may be opened.

The system for removing sand cores of the present invention may be computer controlled. As illustrated schematically in FIG. 1, a computer or programmable logic component 200 may be connected to receive input, shown at 202 in FIG. 1, such as an electrical signal from the crane or from a sensor such as a limit switch to sense when the crane has been aligned with the brush assembly and its linear travel stopped. The programmable logic component 200 can be connected through outputs shown at 204 to control operation of the drive mechanism 92 to move the cart 72 along the rails 82, to start the motor 112 to begin rotating the brush assembly 46, and after the brushes 52 and hood 130 have moved into the interior 33 of the pipe 14, to actuate the powered tilting device 124 to tilt the frame 102 to lower the rotating brushes. The programmable logic component 200 could also be connected to control operation of the powered rollers on the crane 26 so that the direction of rotation of the pipe can be changed during the waste removal process. Alternatively, a separate programmable logic component could control the crane. The programmable logic element 200 could also be connected to control operation of the fan 44 so that the speed of rotation can vary depending upon use.

In the illustrated embodiment, a vertical plate 145 is attached to the exhaust system 48 near the brushes 52. As shown in FIG. 3, the cart 72 is pushed toward the pipe until the plate 145 contacts the bell end of the pipe, or until the plate contacts the outer pancake portion 210 of the core 36. The plate 145 has apertures through which the shaft 50 extends, and provides an opening through which air and waste may travel to enter the exhaust system. Since the distance between the plate 145 and the brushes is fixed, moving the cart 72 until the plate 145 contacts the pipe or core ensures that the brushes 52 are properly positioned within the pipe. The distance between the plate 145 and the brushes 52 can be preset and would depending on whether the pipe or the core is contacted by the plate 145.

A commercially-available programmable logic component may be used. A suitable programmable logic and motion control system is available from Allen-Bradley Co./Rockwell Automation, of Milwaukee, Wis. and other locations, with standard ladder logic suitably programmed, as will be understood by those skilled in the art. It is expected that the supplier would be consulted for selection of an appropriate model of component. A standard PLC with standard logic may be programmed by one skilled in the programming art, such as an electrical engineer, or more sophisticated programming could be developed if desired. It should be understood that this computer control is identified for purposes of illustration only, and that the invention is not limited to use of programmable logic components, to components from this supplier, or to any particular program, computer or PLC.

The present invention also defines a method of removing core sand from the bell end of a cast metal pipe using the system as described above. Preferably, the step of removing the core sand from the cast metal pipe occurs before the pipe is heat-treated at the heat-treating station 18.

In operation, after a pipe 14 has been cast at the casting station 12, the pipe is substantially horizontal. The crane 26 is moved along the runway 28 to a position overlying the pipe 14, and the horizontal pipe is lifted by the crane. Powered rollers on the crane bails rotate the pipe 14 about its horizontal central longitudinal axis 19. The crane 26 moves along a path defined by the runway 28 until the pipe is aligned with the brush assembly 46 of the sand core removal system 40. The crane stops its linear movement at the sand core removal system 40, but the powered rollers preferably continue to rotate the pipe 14 about its central longitudinal axis 19. At this time, the linearly-movable cart 72 is in the retracted position shown in FIG. 2. Preferably, the support frame 86 for the sand core removal system 40 positions the removal system above the plant floor, with the axis 54 of the shaft 50 positioned between the level of the pipe central axis 19 and the level of interior surface 35 of the bottom of the pipe 14.

The linear drive mechanism 92 is actuated to push the linearly-movable cart 72 along the rails 82 toward the pipe, and the brushes 52 and hood 130 enter the opening 37 at the bell end 24 of the pipe, and move into the interior 33 of the pipe. At this time, the brushes 52 are spaced above the sand core 36 in the pipe. The air-moving device 44 is already operating so that air is moved or drawn into the hood 130 through the gap 142, and into the movable duct 132 and stationary duct 140. From the stationary duct 140, the air is moved or drawn into the bag house 42 where it is filtered. The cart 72 fit stops forward motion when the plate 145 contacts the exterior of the bell end of the 65 pipe. With the cart so positioned, the brushes of the cleaning assembly should be properly aligned with the corresponding shape of the pipe interior, as shown in FIGS. 8, 10 and 12.

The motor 112 is actuated to commence rotating the brush assembly 46. After the brushes have commenced rotating, the tilting device 124 is actuated. The tilting device pushes upward on one side of the base plate 110 of the tiltable frame 102, on the side supporting the motor 112 in the illustrated embodiment. The tiltable frame 102 tilts about is tilt axis 70, lowering the brushes to the lowered position as shown in FIG. 3. The brushes 52, rotating at speeds of 1700–1800 revolutions per minute, contact the rotating sand core 36, breaking the sand core into smaller pieces to clean the sand from the interior surface 35 of the bell end 24 of the pipe 14. The draft from the air-moving device 44 pulls the waste sand into the hood 130 of the exhaust system 48. Smaller chunks and particles of sand are drawn into the bag house 42, where they are filtered from the air and collected. Larger chunks of waste sand that do not travel up the steeply inclined part of the stationary duct 140 are collected adjacent the door 150 to the chute 152 at collection location 153. The door 150 is closed at this time due to the pressure differential. The pipe continues to rotate throughout the time the brushes are cleaning the sand from the pipe.

After a predetermined time, the direction of rotation of the pipe 14 on the crane rollers may be reversed to improve cleaning of the pipe. Alternatively or in addition, the direction of rotation of the brush assembly 46 could be reversed. In addition, instead of keeping the brushes 52 in the lowered position throughout the cleaning cycle, it may be desirable to bounce the brushes up and down against the surface of the sand core.

As shown in FIGS. 8–13, the overall contour of the cleaning or brush assembly 46 allows the longer bristles of some of the brushes to reach into the grooves or indentations 47 of the interior surface 35 of the pipe to insure that the interior surface 35 is thoroughly cleaned of sand.

The pancake portion of the sand core 36, on the outside of the pipe 14 and shown at 210 in FIGS. 2, 8, 10 and 12 may be removed manually with a hammer or the like before or after the pipe reaches the sand core removal system 40. Alternatively, the cleaning or brush assembly 46 could include brushes or other devices that would also clean the pancake off of the pipe.

After the sand core has been cleaned from the interior surface 35 of the pipe 14, the brush assembly 46 may be raised away from the surface 35 back to the position shown in FIG. 1 by retracting the piston of the tilting device 124, thereby pulling downward on the motor side of the base plate 110. As the motor side of the base plate 110 is pulled down, the tiltable frame 102 tilts about its tilt axis 70 to raise the brush assembly 46. The motor 112 may be stopped and then the piston 96 of the linear drive 92 may be retracted into the cylinder 94, thereby pulling the rolling cart 72, the brush assembly 46, hood 130 and movable duct 132 away from the pipe. As the movable assembly is pulled back, part of the stationary duct 140 telescopes into part of the movable duct 132. The movable assembly is pulled back until the hood 130 clears the end of the pipe. The crane 26 is then actuated to begin moving linearly along the runway 28 to move the pipe downstream to the upender 30. The pipe is then placed upright with its bell end 24 on one support station 22 of the carousel 20. The carousel 20 is rotated to move the pipe through the heat-treating furnace 18. The heat-treated pipe is removed from the support station 22 by the downender 32 and the pipe then moved to the conveying system 34 for finishing.

Preferably, air continues to move or be drawn through the exhaust system 48 even when the sand core removal system is in the position shown in FIG. 2. The continuous flow of air should adequately cool the ducts between pipe cleanings. The air-moving device 44 may be slowed or stopped periodically so that the pressure in the stationary duct is beyond a set level, allowing the door 150 to be opened. When the door 150 is opened, larger chunks of waste sand that have collected at location 153 can then be removed through the chute 152.

For removing sand cores from cast pipe, the materials used for the parts should be suitable for the anticipated temperatures in the area of the pipe. Generally, most of the parts of the brush assembly, exhaust system, linearly-movable cart and tilting frame are made of steel. Stainless steel may be used, although less expensive forms are desirable provided they provide a suitable working life.

Although the invention has been described in terms of removing a sand core from a cast metal pipe, it should be understood that the invention may be used to remove other waste materials from a casting. For example, the invention may be used in cleaning a pipe end by grinding the pipe after the sand core has been removed and after the pipe has been heat treated and cooled. Use of the exhaust system of the present invention in combination with the cleaning assembly in such a finishing operation can limit the amount of fine metal particles released to the plant environment. The expression "waste materials" should thus be understood to include the sand core in the pipe after casting as well as metal material to be removed in a finishing operation.

And although the present invention is shown with its exhaust system connected to the bag house for the plant, it should be understood that the exhaust system could be connected to a special collector. For example, it may be desirable to collect the sand from the sand core alone for recycling or for separate disposal. If the invention is used to collect metal particles, it may be desirable to collect these particles separate from other waste in the plant for recycling. Thus, the exhaust system could be connected to a separate collector or filter and air-moving device.

It should also be understood that although the illustrated embodiment uses power devices such as the pneumatic drives 92 and 124 to move the cart 72 and to tilt the frame 102, these movements could be accomplished manually as well. Moreover, as discussed above, other types of drives may be used, such as hydraulic cylinders, chain and sprocket, rack and pinion and commercially available linear drives, although drives that yield and that allow the cleaning assembly to be bounced up and down are preferred.

Although the illustrated embodiment shows structures that allow for movement of the cleaning and exhaust assemblies into the pipe, relative movement could alternatively be accomplished by providing structures that move the pipe. For example, the exhaust system and cleaning assembly could be kept linearly stationary, and the pipe could be moved linearly toward and away from the cleaning assembly and hood. Instead of pivoting the cleaning assembly to raise and lower it, the pipe could be moved to contact the cleaning assembly.

It should also be understood that the cleaning or brush assembly 46 could be raised and lowered through means other than tilting, such as through a vertical lift mechanism. Alternatively, the shaft 50 of the cleaning or brush assembly could be made to pivot up and down about a horizontal axis perpendicular to the pipe central longitudinal axis 19, to thereby move the cleaning assembly against and away from the interior surface of the pipe. In such cases, the system need not have a tilting frame as illustrated.

While only a specific embodiment of the invention has been described and shown, it is apparent that various alterations and modifications can be made therein. It is, therefore, the intention in the appended claims to cover all such modifications and alterations as may fall within the scope and spirit of the invention. Moreover, the invention is intended to include equivalent structures and structural equivalents to those described herein.

We claim:

1. A system for removing waste material from the bell ends of cast metal pipe, the pipe having a central longitudinal axis, a hollow interior and an interior surface, the system comprising:

a casting station for casting a cast metal pipe having a bell end;

waste material at the bell end of the cast metal pipe;

a cleaning assembly to clean the waste material from the pipe, at least one of at least part of the cleaning assembly and the pipe being movable so that at least part of the cleaning assembly is inside the pipe and outside of the pipe at different times; and an exhaust system positioned to move waste material away from the pipe after the waste material has been cleaned from the pipe;

wherein the exhaust system includes an intake, a first waste outlet and a waste flow path, the waste flow path extending to a position downstream from the first waste outlet, and wherein the first waste outlet and the waste flow path are positioned so that waste material of a relatively heavier weight exits the exhaust system through the first waste outlet and so that waste material of a relatively lighter weight travels through the waste flow path to a position downstream of the first waste outlet.

2. The system of claim 1 wherein the cleaning assembly is pivotable about a tilt axis parallel to the central longitudinal axis of the pipe to move the axis of rotation toward and away from the interior surface of the pipe.

3. The system of claim 1 wherein the cleaning assembly is rotatable about an axis of rotation and movable in and out of the pipe in a direction parallel to the central longitudinal axis of the pipe.

4. The system of claim 3 wherein the axis of rotation of the cleaning assembly is parallel to the central longitudinal axis of the pipe.

5. The system of claim 1 wherein the exhaust system includes a movable duct movable toward and away from the hollow interior of the pipe, a stationary duct connected to receive exhaust from the movable duct, and an air-moving device for drawing air and waste material into the movable duct and from the movable duct into the stationary duct.

6. The system of claim 5 wherein the stationary duct includes a chute for waste material and a door to open a passage to the chute when pressure in the stationary duct is beyond a set level, said door defining said first waste outlet.

7. The system of claim 5 wherein the exhaust system includes a hood supported to move with the cleaning assembly, the hood being connected to the movable duct.

8. The system of claim 3 wherein the cleaning assembly includes a shaft having a central longitudinal axis and a brush mounted on the shaft, the central longitudinal axis of the shaft defining the axis of rotation for the cleaning assembly.

9. The system of claim 8 further comprising:

a linearly-movable cart;

a tiltable frame supported on the cart, the tiltable frame being tiltable about a tilt axis, the cleaning assembly being supported on the tiltable frame with the shaft central longitudinal axis parallel to the tilt axis of the tiltable frame and with the shaft and brush extending out beyond the tiltable frame and the cart;

a motor mounted on the tiltable frame for rotating the shaft;

a powered tilting device connected to the cart and the tiltable frame to tilt the tiltable frame about its tilt axis to thereby move the brush of the cleaning assembly toward and away from the interior surface of the pipe;

a drive mechanism for moving the cart, tilting frame and brush assembly toward and away from the pipe.

10. The system of claim 9 wherein the exhaust system includes:

a hood and a movable duct supported to move with the cart, the hood overlying at least a part of the cleaning assembly and being movable into and out of the hollow interior of the pipe, at least part of said hood defining the intake into the exhaust system;

a stationary duct connected to receive exhaust from the movable duct when the hood is within the interior of the pipe, the stationary duct being stationary as the cart and movable duct and hood move toward and away from the pipe; and an air-moving device for drawing air and waste material into the hood and through the movable duct to the stationary duct.

11. The system of claim 10 wherein the stationary duct includes a chute for waste material and a door to open a passage to the chute for the waste material when pressure in the stationary duct is beyond a set level, and wherein said door defines said first waste outlet.

12. The system of claim 10 wherein the cleaning assembly has a plurality of brushes mounted concentrically on the shaft, said brushes having varying diameters to define an outer contour corresponding generally to the contour of the interior surface of the bell end of the pipe.

13. The method of removing core sand from the bell end of a cast metal pipe using the system of claim 1, the method including rotating the pipe about its central longitudinal axis while the cleaning assembly is within the interior of the pipe.

14. The system of claim 1 wherein at least one of at least part of the exhaust system and pipe is movable so that at least part of the exhaust system is inside the pipe and outside the pipe at different times.

15. In a plant for making ductile iron pipe with a bell end, a hollow interior and an interior surface, the plant having a casting station for casting the iron pipe with a sand core to define the shape of at least a part of the interior surface of the pipe at the bell end of the pipe, the plant also having a heat-treating station downstream from the casting station to heat treat the pipe, a system for removing the sand core from the cast iron pipe before the cast pipe reaches the heat-treating station comprising:

a brush assembly including a shaft having a central longitudinal axis and a brush mounted on the shaft, the brush assembly being rotatable about the central longitudinal axis of the shaft to clean core sand from the pipe; and an exhaust system positioned to move core sand away from the pipe after the core sand has been cleaned from the pipe, tie exhaust system including a hood;

wherein at least part of said brush is positioned within said hood.

16. The method of removing core sand from the bell end of a cast iron pipe before the pipe is heat-treated using the system of claim 15.

17. The system of claim 15 further comprising:

a linearly-movable cart;

a tiltable frame supported on the cart, the tiltable frame being tiltable about a tilt axis, the brush assembly being supported on the tiltable frame with the shaft central longitudinal axis parallel to the axis of the tiltable frame and with the shaft and brush extending out beyond the tiltable frame and the cart;

a motor mounted on the tiltable frame for rotating the shaft;

a powered tilting device connected to the cart and the tiltable frame to tilt the tiltable frame about its tilt axis to thereby move the brush assembly toward and away from the interior surface of the pipe;

a drive mechanism for moving the cart, tilting frame and brush assembly toward and away from the pipe.

18. The system of claim 17 wherein the exhaust system includes:

a stationary duct connected to receive exhaust from the movable duct when the hood is within the interior of the pipe, the stationary duct being stationary as the cart and movable duct and hood move toward and away from the pipe; and an air-moving device for drawing air and sand from the core into the hood and through the movable duct to the stationary duct; and wherein the hood is movable into and out of the hollow interior of the pipe.

19. The system of claim 18 wherein the stationary duct includes a chute for sand and a door to open a passage to the chute for the sand when pressure in the stationary duct is beyond a set level.

20. The system of claim 15 wherein the brush assembly has a plurality of brushes mounted concentrically on the shaft, said brushes having varying diameters to define an outer contour corresponding generally to the contour of the interior surface of the bell end of the pipe.

21. The system of claim 15 wherein the plant includes a crane for moving a pipe from the casting station to the heat treating station, the crane including rollers for rotating the pipe about its central longitudinal axis, the crane being movable through a path to align the pipe with the brush assembly.

22. In a plant for making ductile iron pipe with a bell end, a hollow interior and an interior surface, the plant having a casting station for casting the iron pipe with a sand core to define the shape of at least a part of the interior surface of the pipe at the bell end of the pipe, the plant also having a heat-treating station downstream from the casting station to heat treat the pipe and a crane for moving a pipe from the casting station to the heat- treating station while rotating the pipe about its central longitudinal axis, a system for removing the sand core from the cast iron pipe before the cast pipe reaches the heat-treating station comprising:

a brush assembly including a shaft and a plurality of annular brushes mounted concentrically on the shaft, the shaft having a central longitudinal axis and the shaft and annular brushes being rotatable about the central longitudinal axis of the shaft;

a linearly-movable cart;

a tiltable frame supported on the cart, the tiltable frame being tiltable about a tilt axis, the brush assembly being supported on the tiltable frame with the shaft central longitudinal axis spaced from and parallel to the tilt axis of the tiltable frame, the shaft and annular brushes extending out beyond the tiltable frame and cart;

a motor on the tiltable frame for rotating the shaft;

a drive mechanism for moving the cart, tilting frame and brush assembly toward and away from the pipe, the annular brushes being movable into the interior of the pipe;

a powered tilting device connected to the cart and the tiltable frame to tilt the tiltable frame about its tilt axis to thereby move the brush assembly toward and away from the interior surface of the pipe;

an exhaust system positioned to move core sand away from the pipe after the core sand has been cleaned from the pipe, the exhaust system including:

a hood and a movable duct supported to move with the cart, the hood overlying the annular brushes of the brush assembly and moving into and out of the interior of the pipe;

a stationary duct connected to receive exhaust from the movable duct when the hood is within the interior of the pipe, the stationary duct being stationary as the cart, movable duct and hood move; and an air-moving device for moving air and sand from the sand core into the hood and through the movable duct to the stationary duct;

wherein at least one of the stationary duct and movable duct is received inside the other of said stationary duct and movable duct in a telescoping manner.

23. The system of claim 22 wherein the interior surface of the bell end of the pipe has a contour and Wherein the annular brushes have diameters to define an outer contour corresponding generally to the contour of the interior surface of the bell end of the pipe.

24. The system of claim 22 wherein the stationary duct includes a chute for sand and a door to open a passage to the chute when pressure in the stationary duct is beyond a set level.

25. The method of removing core sand from a cast iron pipe using the system of claim 22.

26. The method of claim 25 wherein the pipe is rotated about its central longitudinal axis as the brushes are rotated against the sand core.

27. The method of claim 26 wherein the pipe is rotated in two different directions as the brushes are rotated against the sand core.

* * * * *